US010163396B2

(12) United States Patent
Choi

(10) Patent No.: US 10,163,396 B2
(45) Date of Patent: Dec. 25, 2018

(54) ORGANIC LIGHT EMITTING DIODE DISPLAY DEVICE AND DRIVING METHOD THEREOF

(71) Applicant: LG Display Co., Ltd., Seoul (KR)

(72) Inventor: Jin-Sol Choi, Seoul (KR)

(73) Assignee: LG Display Co., Ltd., Seoul (KR)

( * ) Notice: Subject to any disclaimer, the term of this patent is extended or adjusted under 35 U.S.C. 154(b) by 21 days.

(21) Appl. No.: 15/390,887

(22) Filed: Dec. 27, 2016

(65) Prior Publication Data

US 2017/0193912 A1 Jul. 6, 2017

(30) Foreign Application Priority Data

Dec. 31, 2015 (KR) ..... 10-2015-0191554

(51) Int. Cl.
*G09G 3/3258* (2016.01)
*G09G 3/3291* (2016.01)
*G09G 3/3233* (2016.01)

(52) U.S. Cl.
CPC ..... *G09G 3/3258* (2013.01); *G09G 3/3233* (2013.01); *G09G 3/3291* (2013.01); *G09G 2300/0819* (2013.01); *G09G 2300/0842* (2013.01); *G09G 2310/0262* (2013.01);
(Continued)

(58) Field of Classification Search
CPC .. G09G 3/3258; G09G 3/3208; G09G 3/3225; G09G 3/3291; G09G 2310/08; G09G 2300/0819; G09G 2320/045
See application file for complete search history.

(56) References Cited

U.S. PATENT DOCUMENTS 6,995,519 B2 2/2006 Arnold et al.
2006/0082528 A1 4/2006 Guo et al.
(Continued)

FOREIGN PATENT DOCUMENTS

JP 2011508260 A 3/2011
TW I237913 B 8/2005
TW I489433 B 6/2015

OTHER PUBLICATIONS

Notice of Reason for Refusal dated Nov. 14, 2017 from the Japanese Patent Office in counterpart Japanese application No. 2016-242980.
(Continued)

*Primary Examiner* — Ibrahim A Khan
(74) *Attorney, Agent, or Firm* — Morgan, Lewis & Bockius LLP

(57) ABSTRACT

An organic light emitting diode (OLED) display device includes a display panel including a pixel that includes a driving transistor and a light emitting diode; a timing control circuit including a compensation value calculation portion that calculates a compensation value (β) of the light emitting diode using a first correlation equation having a threshold voltage change quantity (ΔVth) of the driving transistor as a variable, and a data compensation portion that applies the calculated compensation value to an input image data to produce a compensation data; and a data driver receiving the compensation data and supplying the compensation data to the pixel, wherein the first correlation equation is $\beta=a*\Delta Vth+b$, where a is a first gradient constant, and b is a first intersect constant.

13 Claims, 5 Drawing Sheets

(52) U.S. Cl.
CPC ... *G09G 2310/08* (2013.01); *G09G 2320/045* (2013.01); *G09G 2320/046* (2013.01)

(56) References Cited

U.S. PATENT DOCUMENTS

2008/0074362 A1* 3/2008 Ogura ..... G09G 3/3275 345/77
2008/0211397 A1* 9/2008 Choi ..... G09G 3/3233 313/504
2008/0231562 A1* 9/2008 Kwon ..... G09G 3/3233 345/77
2008/0252568 A1* 10/2008 Kwon ..... G09G 3/3233 345/76
2008/0252569 A1* 10/2008 Kwon ..... G09G 3/3233 345/76
2009/0002405 A1* 1/2009 Ozaki ..... G09G 3/325 345/690
2009/0027377 A1* 1/2009 Kwon ..... G09G 3/3233 345/214
2009/0160740 A1 6/2009 Leon et al.
2009/0278833 A1* 11/2009 Tomida ..... G09G 3/3233 345/211
2009/0284519 A1* 11/2009 Kim ..... G09G 3/3233 345/213
2010/0079423 A1* 4/2010 Takei ..... G09G 3/30 345/205
2010/0134468 A1* 6/2010 Ogura ..... G09G 3/3291 345/211
2010/0188377 A1* 7/2010 Ota ..... G09G 3/3233 345/205
2011/0032243 A1* 2/2011 Tsuji ..... G09G 3/3283 345/212
2011/0032281 A1* 2/2011 Ietomi ..... G09G 3/3233 345/690
2011/0157134 A1* 6/2011 Ogura ..... G09G 3/20 345/211
2011/0205250 A1* 8/2011 Yoo ..... G09G 3/3233 345/690
2014/0092076 A1 4/2014 Lee
2014/0198092 A1* 7/2014 Azizi ..... G09G 3/006 345/212
2015/0001504 A1* 1/2015 Kim ..... H01L 27/32 257/40
2015/0124004 A1* 5/2015 Hayashi ..... G09G 3/3233 345/690

OTHER PUBLICATIONS

The First Office Action dated Sep. 15, 2017 from the Taiwan Patent Office in counterpart Taiwan application No. 105143037.

* cited by examiner

200

ORGANIC LIGHT EMITTING DIODE DISPLAY DEVICE AND DRIVING METHOD THEREOF

The present application claims the priority benefit of Korean Patent Application No. 10-2015-0191554, filed in the Republic of Korea on Dec. 31, 2015, which is hereby incorporated by reference in its entirety for all purposes as if fully set forth herein.

BACKGROUND

Field of the Invention

The present invention relates to an organic light emitting diode (OLED) display device, and more particularly, to an OLED display device and a driving method thereof that can efficiently compensate for deterioration of an organic light emitting diode.

Discussion of the Related Art

Recently, flat panel display devices having excellent properties, such as a thin profile, low weight, low power consumption and the like, have been developed and applied to various fields.

Among the flat panel display devices, an organic light emitting diode (OLED) display device emits light by combining electrons and holes in a light emitting layer.

Typically, the OLED display device can be formed on a flexible substrate, has a high contrast ratio because it is a self-luminous type device, displays moving images easily because its response time is several micro-seconds, has no limit to viewing angles, and is stable at low temperatures. Further, because the OLED display device can operate with a relatively low voltage of DC 5V to 15V, it may be easy to fabricate and design a driving circuit.

However, the OLED display device can have a problem in that due to the characteristics of the OLED, the property of the OLED changes over time and may deteriorate. For example, when a fixed pattern image is displayed for a long time, deterioration of the OLED in the displayed portion may be accelerated. This may cause an afterimage to occur in the deteriorated portion, thereby degrading the display quality.

As a solution to prevent the deterioration, a method to reduce a brightness for the fixed pattern image portion has been suggested. This method may be confined to only deterioration prevention, and may not compensate for actual deterioration of the OLED when it occurs.

As a solution to compensate for the deterioration, a method may be provided where an OLED is directly sensed to detect a deterioration, and a compensation data is generated using a LUT (look-up table) produced through deterioration experiments. However, this direct sensing compensation method may need a large amount of LUT data, and thus a compensation time may be long. Furthermore, complexity of the compensation algorithm may be high, and thus a size of a logic circuit may increase as well as the cost of the compensation circuit.

SUMMARY

Accordingly, the present invention is directed to an OLED display device and a driving method thereof that substantially obviates one or more of the problems due to limitations and disadvantages of the related art.

An object of the present invention is to efficiently compensate for deterioration of an organic light emitting diode.

Additional features and advantages of the disclosure will be set forth in the description which follows, and in part will be apparent from the description, or may be learned by practice of the disclosure. The advantages of the disclosure will be realized and attained by the structure particularly pointed out in the written description and claims as well as the appended drawings.

To achieve these and other advantages, and in accordance with the purpose of the present invention, as embodied and broadly described herein, an organic light emitting diode (OLED) display device includes a display panel including a pixel having a driving transistor and a light emitting diode; a timing control circuit including: a compensation value calculation portion that calculates a compensation value ($\beta$) of the light emitting diode using a first correlation equation, the first correlation equation including a threshold voltage change quantity ($\Delta Vth$) of the driving transistor as a variable, and a data compensation portion that applies the calculated compensation value of the light emitting diode to an input image data to produce a compensation data; and a data driver receiving the compensation data and supplying the compensation data to the pixel, wherein the first correlation equation is $\beta=a*\Delta Vth+b$, where a is a first gradient constant, and b is a first intersect constant.

In another aspect, a method of driving an organic light emitting diode (OLED) display device includes calculating a compensation value ($\beta$) of a light emitting diode of a pixel using a first correlation equation, the first correlation equation including a threshold voltage change quantity ($\Delta Vth$) of a driving transistor of the pixel as a variable, and applying the calculated compensation value of the light emitting diode to an input image data to produce a compensation data, in a timing control portion; and supplying the compensation data from the timing control portion to the pixel through a data driver, wherein the first correlation equation is $\beta=a*\Delta Vth+b$, where a is a first gradient constant, and b is a first intersect constant.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION OF THE ILLUSTRATED EMBODIMENTS

Reference will now be made in detail to embodiments, examples of which are illustrated in the accompanying drawings. The same or like reference numbers may be used throughout the drawings to refer to the same or like parts.

Figure 1:
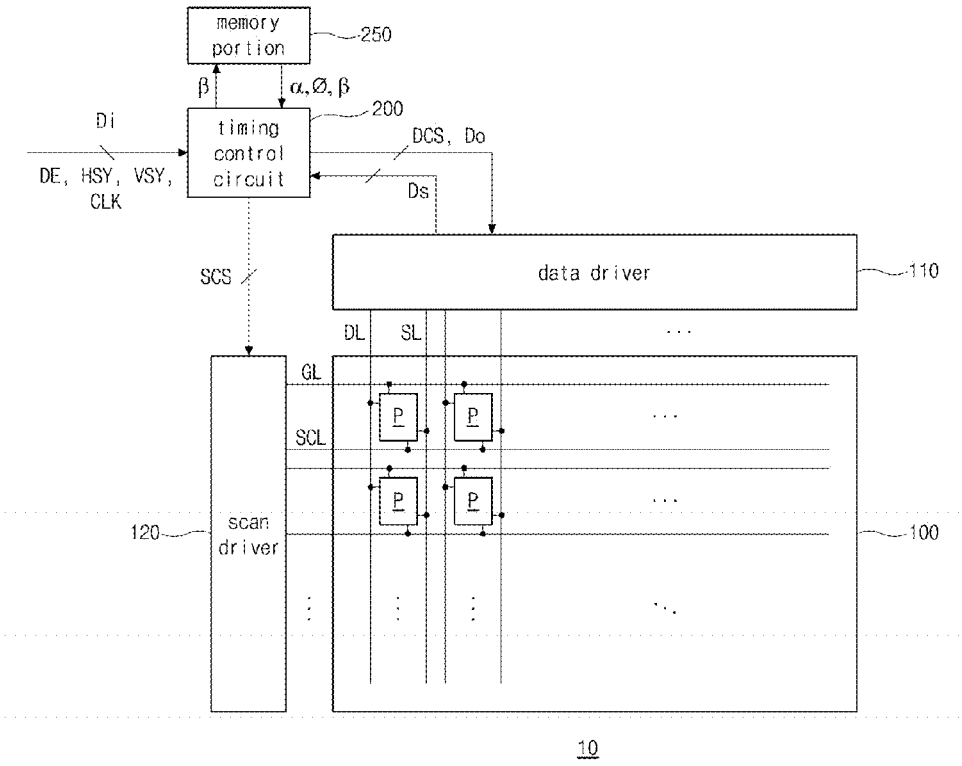
FIG. 1 is a block diagram illustrating an OLED display device according to an embodiment of the present invention.
Figure 2:
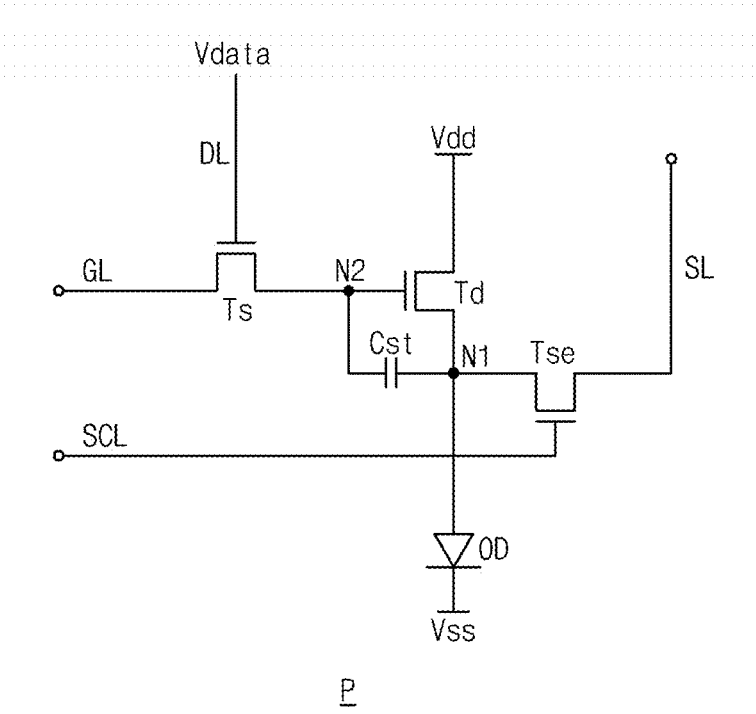
FIG. 2 is a view illustrating an exemplary equivalent circuit of a pixel according to an embodiment of the present invention.

FIG. 1 is a block diagram illustrating an OLED display device according to an example embodiment of the present invention, and FIG. 2 is a view illustrating an exemplary equivalent circuit of a pixel according to an example embodiment of the present invention.

With reference to FIG. 1, the OLED display device 10 of the embodiment includes a display panel 100, a data driver 110, a scan driver 120, a timing control circuit (or timing control portion) 200, and a memory portion 250.

The display panel 100 includes a plurality of pixels P arranged in a matrix form along rows and columns. In the array substrate of the display panel 100, gate lines GL extending along respective row lines and each supplying a gate signal to a pixel on each row line, and data lines DL extending along respective column lines and each supplying a image data, e.g., a data voltage to a pixel on each column line are formed.

Furthermore, in the array substrate, sensing control lines SCL extending along respective row lines and each supplying a sensing control signal to a pixel on each row line may be formed. In the array substrate, sensing lines SL extending along respective column lines, each supplying a reference voltage to a pixel on each column line, and each supplying a sensing signal to sense a property value such as a threshold voltage to the data driver 110 may be formed.

An example of a structure of the pixel P is explained further with reference to FIG. 2. The pixel P includes a switching transistor Ts, a driving transistor Td, a sensing transistor Tse, a light emitting diode OD, and a storage capacitor Cst. The pixel P may further include another type of transistor.

The switching transistor Ts functions to supply a data signal Vdata, e.g., a data voltage, which is supplied through the data line DL, to the driving transistor Td according to the gate signal which is supplied through the gate line GL. The driving transistor Td functions to supply a high-level power voltage Vdd, which is supplied through the a power line, to the light emitting diode OD according to the data signal Vdata applied to a gate of the driving transistor Td.

To do this, a gate, a source, and a drain of the switching transistor Ts are connected to the gate line GL, the data line DL, and the gate of the driving transistor Td, respectively. The gate, a source, and a drain of the driving transistor Td are connected to the drain of the switching transistor Ts, a first electrode of the light emitting diode OD, and the power line, respectively.

The source of the driving transistor Td and the first electrode of the light emitting diode OD are connected at a first node N1 therebetween, and the gate of the driving transistor Td and the drain of the switching transistor Ts are connected at a second node N2 therebetween. The storage capacitor Cst is connected between the first and second nodes N1 and N2.

Accordingly, a current corresponding to the data signal Vdata is supplied to the light emitting diode OD and gray levels are displayed.

The sensing transistor Tse is connected to the first node N1 and functions to sense a voltage and/or a current of the first node N1. A gate, a source, and a drain of this sensing transistor Tse are connected to the sensing control line SCL, the first node N1, and the sensing line SL, respectively.

Using such a sensing transistor Tse, a property, such as a threshold voltage Vth, a mobility, or the like, may be detected. To do this, the sensing transistor Tse may be switched according to the sensing control signal supplied through the sensing control signal SCL. When the sensing transistor Tse is turned on, the reference voltage is applied to the first node N1 through the sensing line SL, and then the voltage and/or the current of the first node N1 is sensed and output to the data driver 110 (see FIG. 1) through the sensing line SL.

With further reference to FIG. 1, the scan driver 120 is supplied with a scan control signal SCS from the timing control circuit 200, and generates and supplies a gate control signal and the sensing control signal to the gate line GL and the scan control line SCL, respectively.

The scan driver 120 may be formed directly in the array substrate of the display panel 110 in a GIP (gate-in panel) type. Alternatively, the scan driver 120 may be formed in an IC type. In the GIP type, the scan driver 120 may be formed through the same processes of forming elements in the pixel P.

The data driver 110 receives digital image data Do and a data control signal DCS from the timing control circuit 200. In response to the data control signal DCS, the data driver 110 converts the image data Do into data voltages of analog image data and outputs the data voltages to the respective data lines DL. The data driver 110 may be configured with at least one driving IC and be mounted on the array substrate of the display panel 100.

The data driver 110 converts the analog sensing signal transferred through the sensing line SL into a corresponding digital signal, and the digital sensing signal Ds is transferred to the timing control circuit 200.

The timing control circuit 200 is supplied with image data Di and various timing signals such as an enable signal DE, a horizontal synchronization signal HSY, a vertical synchronization signal VSY and a clock signal CLK from an external host system through an interface such as an LVDS (low voltage differential signaling) interface, a TMDS (transition minimized differential signaling) interface, or the like. Using the timing signals, the timing control circuit 200 generates and outputs the data control signal DCS and the scan control signal SCS to the data driver 110 and the scan driver 120, respectively.

For example, in this embodiment, the timing control circuit 200 regards a change quantity ΔVth of a threshold voltage Vth of the driving transistor Td as a variable, calculates a compensation value β of the light emitting diode OD according to the threshold voltage change quantity ΔVth, and applies this compensation value β to the input image data Di to generate the compensation data Do. The compensation data Do is output as the image data Do to the data driver 110. Accordingly, the deterioration of the light emitting diode OD can be efficiently compensated for. The calculation of the compensation value β and the generation of the compensation data Do are explained in detail below.

The memory portion 250 may store information of the threshold voltage Vth of the driving transistor Td of each pixel P, and information of the compensation value β of the light emitting diode OD calculated in the timing control circuit 200. The memory portion 250 may further store information of compensation values α and ϕ of the driving transistor Td.

The information of the threshold voltage Vth may be detected in the timing control circuit 200 using the sensing signal Ds transferred from the data driver 110. For example, as the information of the threshold voltage Vth, an initial threshold voltage Vthi detected at an initial state of the display device 10 and a current threshold voltage Vthc detected at a current state of the display device 10 may be stored in the memory portion 250.

The compensation values α and ϕ of the driving transistor Td are values provided to compensate for a property change due to deterioration of the driving transistor Td. In this regard, the driving transistor Td may change in threshold voltage and/or mobility due to a deterioration thereof, and to compensate for this, a threshold voltage compensation value ϕ to compensate for the threshold voltage change and a mobility compensation value α to compensate for the mobility change are used as property change compensation values of the driving transistor Td. In this embodiment, by way of example, both the mobility compensation value α and the threshold voltage compensation value ϕ are used to compensate for both the mobility and the threshold voltage of the driving transistor Td, but embodiments are not limited thereto.

The compensation values α and ϕ of the driving transistor Td are stored in the memory portion 250. When the current threshold voltage Vthc is input to the memory portion 250, in response to this input, the compensation values α and ϕ of the driving transistor Td corresponding to the input threshold voltage Vthc are output to the timing control circuit 200. The information of the compensation values α and ϕ may be prepared in advance through experiments.

The compensation value β of the light emitting diode OD may be calculated in the timing control circuit 200 and then transferred to and stored in the memory portion 250. The compensation value β of the light emitting diode OD along with the compensation values α and ϕ of the driving transistor Td may be output to the timing control circuit 200 in synchronization with an input timing of the input image data Di.

When the compensation values α, ϕ, and β are input to the timing control circuit 200, the timing control circuit 200 applies the compensation values α, ϕ, and β to the input image data Di to finally generate the compensation data Do, and the compensation data Do is output to the data driver 110.

Accordingly, the data driver 110 is supplied with the compensation data to compensate for the property change due to deterioration of each pixel P, and thus the degradation of display quality, such as an afterimage due to the deterioration, can be improved.

Figure 3:
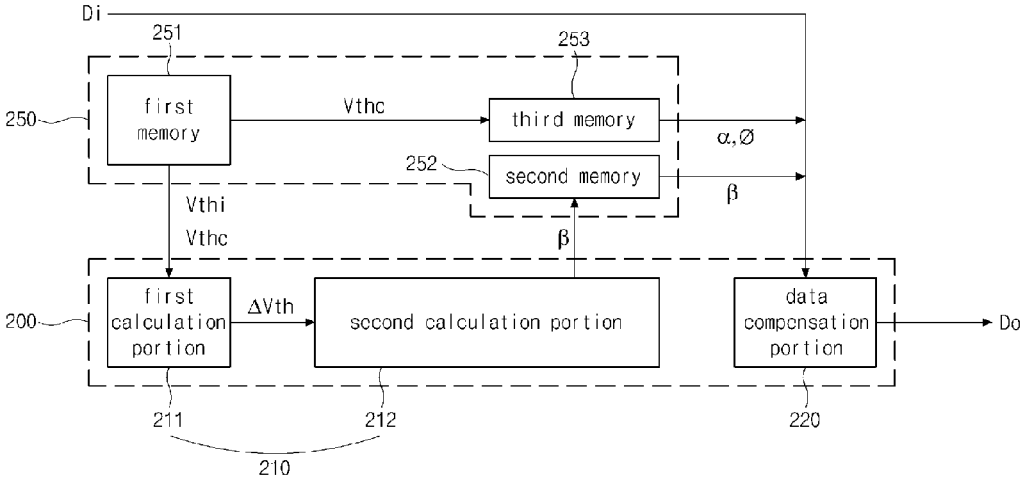
FIG. 3 is a block diagram illustrating a timing control circuit and a memory portion according to an embodiment of the present invention.

Configuration and operation of the timing control circuit 200 to perform compensation for deterioration are explained further with reference to FIG. 3. FIG. 3 is a block diagram illustrating a timing control circuit and a memory portion according to an example embodiment of the present invention.

The timing control circuit 200 may include a compensation value calculation portion 210 to calculate the compensation value β to compensate for deterioration of the light emitting diode OD, and a data compensation portion 220 to compensate for the input image data Di and generate and output the compensation data Do.

The memory portion 250, which transmits to and receives from the timing control circuit 200 information to generate the compensation value β and the compensation data Do, may include first to third memories 251 to 253.

The first memory 251 is a storing member where the threshold voltages Vthi and Vthc are written, and may be, for example, a NAND memory. The second memory 252 is a storing member where the compensation value β of the light emitting diode OD is written, and the third memory 253 is a storing member where the compensation values α and ϕ of the driving transistor Td are written. The second and third memories 252 and 253 may each be, for example, a high-speed memory such as a DDR memory.

The compensation value calculation portion 210 is a component to produce the compensation value β of the light emitting diode OD according to the threshold voltage change quantity ΔVth of the driving transistor Td. The compensation value calculation portion 210 may include first and second calculation portions 211 and 212.

The first calculation portion 211 is supplied with the initial threshold voltage Vthi and the current threshold voltage Vthc of the driving transistor Td of each pixel P from the first memory 251, and calculates a difference between the threshold voltages Vthi and Vthc to produce the threshold voltage change quantity ΔVth. In other words, the threshold voltage change quantity ΔVth is Vthc−Vthi.

The second calculation portion 212 is supplied with the threshold voltage change quantity ΔVth from the first calculation portion 211, and produces the compensation value β using a correlation equation between the threshold voltage change quantity ΔVth and the compensation value β.

The correlation equation between the threshold voltage change quantity ΔVth and the compensation value β may be expressed in a following equation (1).

$$\beta = a * \Delta Vth + b. \qquad \text{Equation (1)}$$

In equation (1), a is a gradient constant, and b is a intercept constant. a and b may be adjusted according to a property of the display panel 100.

As such, the threshold voltage change quantity ΔVth and the compensation value β have a first order correlation, which can be drawn through experimental data.

Figure 4:
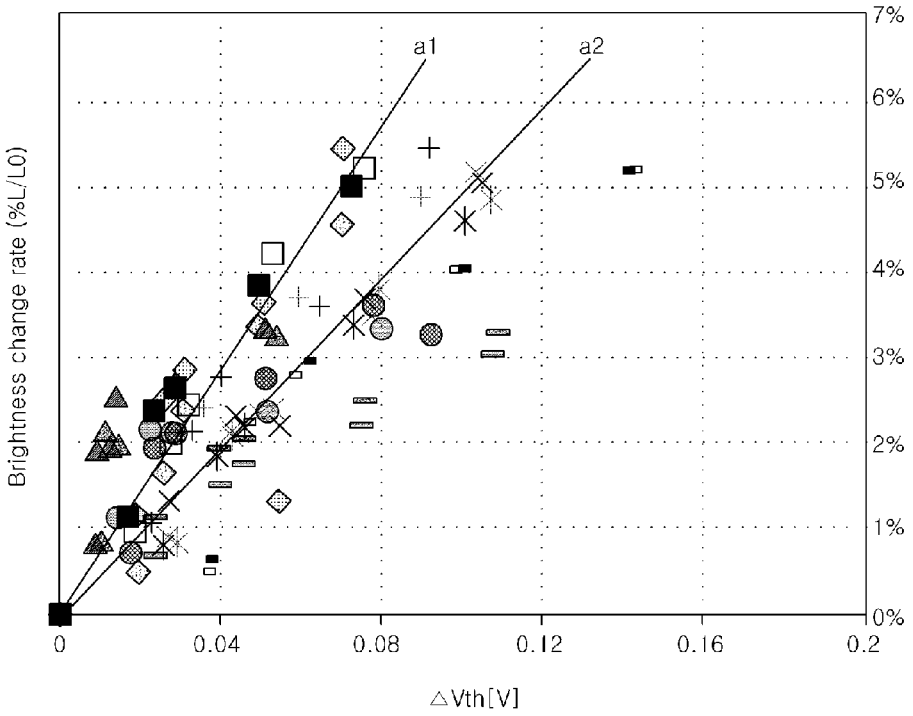
FIG. 4 is a view illustrating experimental data for a correlation between a threshold voltage change quantity and a brightness change rate of a light emitting diode according to an embodiment of the present invention.

For example, FIG. 4 is a view illustrating experimental data for a correlation between a threshold voltage change quantity and a brightness change rate of a light emitting diode according to an example embodiment of the present invention. In FIG. 4, with display devices having different initial properties as experimental samples, experimental data for each experimental sample are shown, and the same experimental sample are indicated with the same shape and same gray color.

With reference to FIG. 4, for each of the experimental samples, the threshold voltage change quantity ΔVth of the driving transistor Td due to deterioration and the brightness change rate of the light emitting diode OD substantially has a first order equation correlation, e.g., a linear correlation. The brightness change rate means a change % of a brightness at a current state with respect to a brightness at an initial state.

The deterioration amount of the light emitting diode OD has a first order correlation with the threshold voltage change quantity ΔVth of the driving transistor Td. Accordingly, when the deterioration amount of the light emitting diode OD for the threshold voltage change quantity ΔVth of the driving transistor Td is drawn based on the experimental data, the compensation value β according to the threshold voltage change quantity ΔVth can be effectively calculated.

Thus, in this embodiment, by performing an arithmetic operation using the above correlation equation produced through the experimental data with the change quantity ΔVth of the current threshold voltage as a variable, the compensation value β can be produced.

With reference to FIG. 4, the different samples have different gradient constants. For example, the first experimental sample (e.g., a squared sample) has a first gradient constant a1, and the second experimental sample (e.g., a circled sample) has a second gradient constant a2 different from the first gradient constant a1. This means that even though the same threshold voltage change quantity ΔVth occurs in different samples, the deterioration amounts of the light emitting diodes OD are different and the compensation values β are different.

As such, the gradient constant a in the equation (1) has a relation of depending on an initial property, e.g., an initial threshold voltage Vthi of the driving transistor Td. In other words, the first experimental sample of the relatively high brightness change rate is a case where an initial threshold voltage Vthi is relatively low, and thus the deterioration amount of the light emitting diode OD is relatively large. In contrast, the second experimental sample of the relatively low brightness change rate is a case where an initial threshold voltage Vthi is relatively high, and thus the deterioration amount of the light emitting diode OD is relatively small.

Figure 5:
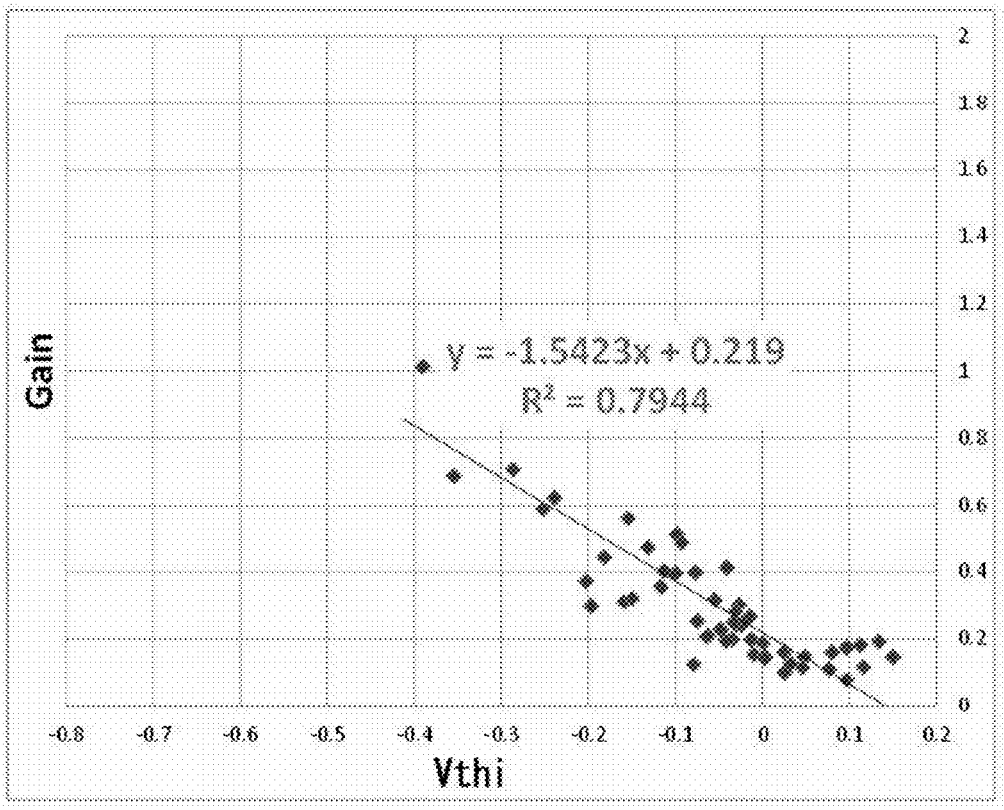
FIG. 5 is a view illustrating experimental data for a correlation between an initial threshold voltage and a gradient constant of an equation (1) according to an embodiment of the present invention.

FIG. 5 is a view illustrating experimental data for a correlation between an initial threshold voltage and a gradient constant of an equation (1) according to an example embodiment of the present invention.

With reference to FIG. 5, an initial threshold voltage Vthi and a gradient constant a (e.g., a gain) of the equation (1) substantially has a negative (−) first order correlation. In other words, for the same threshold voltage change quantity ΔVth, as the initial threshold voltage Vthi is reduced, the deterioration amount of the light emitting diode OD relatively increases and thus the gradient constant, e.g., the gain to compensate for the deterioration increases. In contrast, as the initial threshold voltage Vthi increases, the deterioration amount of the light emitting diode OD relatively is reduced and thus the gradient constant, e.g., the gain to compensate for the deterioration is reduced.

The correlation between the initial threshold voltage Vthi and the gradient constant a may be expressed in a following equation (2).

$$a=c*Vthi+d. \qquad \text{Equation (2)}$$

In the equation (2), c is a gradient constant, and d is a intersect constant. c and d may be adjusted according to a property of the display panel 100.

Finally, the equation (1) can be expressed as follows:

$$\beta=a*\Delta Vth+b=(c*Vthi+d)*\Delta Vth+b. \qquad \text{Equation (1)}$$

According to equation (1), when the change quantity ΔVth of the current threshold voltage Vthc with respect to the initial threshold voltage Vthi for each pixel P is obtained, the compensation value β of the light emitting diode OD can be calculated.

Thus, in this example embodiment, the initial threshold voltage Vthi and the current threshold voltage Vthc are detected and stored in the first memory 251, and the first calculation portion 211 calculates the threshold voltage change quantity ΔVth.

The initial threshold voltage Vthi and the threshold voltage change quantity ΔVth are put in equation (1), and thus the compensation value β to compensate for the deterioration of the light emitting diode OD may be easily produced.

The compensation value β obtained through the compensation value calculation portion 210 may be loaded on the second memory 252.

The third memory 253 may be configured to load the compensation values α and ϕ to compensate for the deterioration of the driving transistor Td. For example, when an information of a threshold voltage, for example, a current threshold voltage Vthc is input from the first memory 251 to the third memory 253, in response to this, the corresponding compensation values α and ϕ can be loaded on the third memory 253.

The compensation value β loaded on the second memory 252 and the compensation values α and ϕ loaded on the third memory 253 may be output in synchronization with the input timing of the input image data Di of the corresponding pixel P. In other words, in synchronization with the input timing to the timing control circuit 200 of the input image data Di of each pixel P, the second and third memories output the compensation value β and the compensation values α and ϕ to the timing control circuit 200, respectively.

The input image data Di, the compensation value β, and the compensation values α and ϕ are simultaneously input to the data compensation portion 220 of the timing control circuit 200, and the data compensation portion 220 applies the compensation values β, α, and ϕ to the input image data Di to perform a data compensation. For example, the data compensation may be performed using a following equation (3).

$$Do=\alpha*Di+\phi+\beta. \qquad \text{Equation (3)}$$

According to equation (3), the compensation data (α*Di+ϕ) can be generated by applying the mobility compensation value α and the threshold compensation value ϕ of the driving transistor Td to the input image data Di. Furthermore, the compensation data Do to compensate for the deterioration of the light emitting diode OD can be generated by applying the compensation value β of the light emitting diode OD to the compensation data (α*Di+ϕ).

In other words, according to the equation (3), the compensation data Do to compensate for both the deterioration of the driving transistor Td and the deterioration of the light emitting diode OD can be produced. Accordingly, the deteriorations of the driving transistor Td and the light emitting diode OD of the elements substantially caused to be deteriorated in each pixel can be compensated for, and the deterioration of each pixel P can be substantially improved.

Alternatively, without compensation for the deterioration of the driving transistor Td, compensation for the deterioration of the light emitting diode OD may be performed. In this example, for the equation (3), the compensation values α and ϕ of the driving transistor Td are not applied (i.e., α=1 and ϕ=0), and the compensation value β of the light emitting diode OD is applied.

The compensation data Do obtained by the data compensation portion 220 is output as an output image data Do to the data driver 110, and the data driver 110 converts the compensation data Do into the data voltage and supplies the data voltage to the corresponding pixel P. Accordingly, the pixel P is supplied with the compensation data Do, and the deterioration of the driving transistor Td and the deterioration of the light emitting diode OD can be compensated for.

As described above, in this embodiment, in order to compensate for the deterioration of the light emitting diode, the compensation value of the light emitting diode is calculated using the correlation equation which is produced through experiments and has the first order correlation with the threshold voltage change quantity of the driving transistor, and the compensation data is generated using the compensated value.

As such, in this example embodiment, by using a method of calculating the compensation value of the light emitting diode according to the threshold voltage change quantity through the correlation equation, efficiency of the compensation for the deterioration of the light emitting diode can be much improved compared to the related art direct sensing compensation method.

In other words, in the related art direct sensing compensation method, a large amount of LUT data is needed, and thus a compensation time is long. Further, a complexity of the compensation algorithm is high, and thus a size of a logic circuit increases and a cost of a compensation circuit increases.

To the contrary, in this example embodiment, by calculating the compensation value of the light emitting diode through the correlation equation, a large amount of LUT data is not needed, and thus, a logic circuit realizing the correlation equation can be easily achieved. Accordingly, a compensation time can be very short, a cost of a compensation circuit can be reduced, and compensation efficiency can be maximized.

Furthermore, the compensation for the driving transistor along with the compensation for the light emitting diode can be performed, and thus the compensation effect for the deterioration of the display panel may be maximized.

It will be apparent to those skilled in the art that various modifications and variations can be made in a display device of the present invention without departing from the sprit or scope of the disclosure. Thus, it is intended that the present invention covers the modifications and variations of this disclosure provided they come within the scope of the appended claims and their equivalents.

What is claimed is:

1. An organic light emitting diode (OLED) display device, comprising:

a display panel including a pixel having a driving transistor and a light emitting diode;

a timing control circuit including:

a compensation value calculation portion configured to calculate a compensation value of the light emitting diode with a first order equation correlation with a threshold voltage change quantity of the driving transistor, wherein the threshold voltage change quantity is a difference between a current threshold voltage and an initial threshold voltage of the driving transistor, and a data compensation portion configured to apply the calculated compensation value of the light emitting diode to an input image data to produce a compensation data; and a data driver configured to receive the compensation data and supply the compensation data to the pixel, wherein a gain of the compensation value of the light emitting diode to the threshold voltage change quantity of the driving transistor has a negative first order equation correlation with the initial threshold voltage of the driving transistor.

2. The OLED display device of claim 1, wherein the data compensation portion is configured to apply a compensation value of the driving transistor along with the compensation value of the light emitting diode to the input image data to produce the compensation data.

3. The OLED display device of claim 2, wherein the compensation value of the driving transistor includes a threshold voltage compensation value to compensate for a threshold voltage change of the driving transistor and a mobility compensation value to compensate for a mobility change of the driving transistor.

4. The OLED display device of claim 3, wherein the data compensation portion generates a first compensation data by applying the compensation value of the driving transistor to the input image data and produces the compensation data by adding the compensation value of the light emitting diode to the first compensation data thereby producing the compensation data.

5. The OLED display device of claim 2, further comprising;

a first memory configured to store the initial threshold voltage and the current threshold voltage of the driving transistor to be input to the compensation value calculation portion;

a second memory configured to load the compensation value of the light emitting diode calculated by the compensation value calculation portion; and a third memory configured to load the compensation value of the driving transistor corresponding to the current threshold voltage, wherein the second memory and the third memory are configured to output the compensation value of the light emitting diode and the compensation value of the driving transistor to the data compensation portion, respectively, in synchronization with an input timing of the input image data.

6. The OLED display device of claim 5, wherein the compensation value calculation portion includes a first calculation portion and a second calculation portion, wherein the first calculation portion is supplied with the initial threshold voltage and the current threshold voltage from the first memory, and calculates a difference between the initial threshold voltage and the current threshold voltage to produce the threshold voltage change quantity; the second calculation portion is supplied with the threshold voltage change quantity from the first calculation portion, and produces the compensation value of the light emitting diode.

7. The OLED display device of claim 1, wherein as the initial threshold voltage is reduced, the gain increases.

8. A method of driving an organic light emitting diode (OLED) display device, comprising:

calculating a compensation value of a light emitting diode of a pixel with a first order equation correlation with a threshold voltage change quantity of a driving transistor of the pixel, and applying the calculated compensation value of the light emitting diode to an input image data to produce a compensation data, in a timing control portion; and supplying the compensation data from the timing control portion to the pixel through a data driver, wherein the threshold voltage change quantity is a difference between a current threshold voltage and an initial threshold voltage of the driving transistor, wherein a gain of the compensation value of the light emitting diode to the threshold voltage change quantity of the driving transistor has a negative first order equation correlation with the initial threshold voltage of the driving transistor.

9. The method of claim 8, wherein producing the compensation data includes:

applying a compensation value of the driving transistor along with the compensation value of the light emitting diode to the input image data to produce the compensation data, in the timing control portion.

10. The method of claim 9, further comprising;

receiving the initial threshold voltage and the current threshold voltage stored in a first memory, calculating the threshold voltage change quantity, and calculating the compensation value of the light emitting diode, in the timing control portion;

loading the compensation value of the light emitting diode calculated in the timing control portion on a second memory;

loading the compensation value of the driving transistor corresponding to the current threshold voltage on a third memory; and outputting the compensation value of the light emitting diode from the second memory and the compensation value of the driving transistor from the third memory to the timing control portion, in synchronization with an input timing of the input image data.

11. The method of claim 9, wherein the compensation value of the driving transistor includes a threshold voltage compensation value to compensate for a threshold voltage change of the driving transistor and a mobility compensation value to compensate for a mobility change of the driving transistor.

12. The method of claim 11, wherein a first compensation data is generated by applying the compensation value of the driving transistor to the input image data, and the compensation data is produced by adding the compensation value of the light emitting diode to the first compensation data thereby producing the compensation data.

13. The method of claim 8, wherein as the initial threshold voltage is reduced, the gain increases.

* * * * *